US005949396A

United States Patent [19]

Lee

[11] Patent Number: 5,949,396

[45] Date of Patent: Sep. 7, 1999

[54] THIN FILM TRANSISTOR-LIQUID CRYSTAL DISPLAY

[75] Inventor: Sung-Su Lee, Pohang-si, Rep. of Korea

[73] Assignee: LG Semicon Co., Ltd., Chungcheongbuk-Do, Rep. of Korea

[21] Appl. No.: 08/902,904

[22] Filed: Jul. 30, 1997

[30] Foreign Application Priority Data

Dec. 28, 1996 [KR] Rep. of Korea ..... 96-75728

[51] Int. Cl.[6] ..... G09G 3/36

[52] U.S. Cl. ..... 345/87; 345/96

[58] Field of Search ..... 345/94, 96, 98, 345/100, 211, 26, 87, 209, 92, 93; 349/39

[56] References Cited

U.S. PATENT DOCUMENTS

| | | | |
|---|---|---|---|
| 5,486,842 | 1/1996 | Kim | 345/26 |
| 5,712,652 | 1/1998 | Sato et al. | 345/90 |
| 5,754,156 | 5/1998 | Erhart et al. | 345/98 |

OTHER PUBLICATIONS

I–Wei Wu, "High–definition displays and technology trends in TFT–LCDs", Journal of the Society for Information Display (1994) vol. 2 Apr., No. 1, pp. 1–14.

*Primary Examiner*—Richard A. Hjerpe
*Assistant Examiner*—Francis N. Nguyen
*Attorney, Agent, or Firm*—Morgan, Lewis & Bockius LLP

[57] ABSTRACT

A liquid crystal display panel includes a pixel array with a plurality of pixels arranged in a matrix of n rows and m columns, N signal lines each for applying a data signal to a predetermined pixel, a plurality of switching devices each formed at every pixel to turn on or off a path through which a data signal from a predetermined signal line is transmitted to a predetermined pixel according to a control signal, and M control lines for applying the control signal to each switching device, wherein the (2n−1)th signal line diverges at a predetermined point and passes through the (2n−1)th and (2n)th pixel columns in common, and the (2n)th signal line diverges at a predetermined point and passes through the (2n)th and (2n−1)th pixel columns in common, odd pixels of the (2n)th pixel column receiving a data signal loaded on the (2n)th signal line, even pixels of the (2n)th pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the (2n)th signal line.

8 Claims, 5 Drawing Sheets

THIN FILM TRANSISTOR-LIQUID CRYSTAL DISPLAY

This application claims the benefit of Korean Patent Application NO. 96-75728 filed on Dec. 28, 1996, which is hereby incorporated by reference.

BACKGROUND OF THE INVENTION

1. Field of the Invention

The present invention relates to a thin film transistor-liquid crystal display (TFT-LCD), and more particularly, to a pixel array structure of a TFT-LCD.

2. Discussion of Related Art

In a TFT-LCD of an active matrix liquid crystal display (AMLCD) driven by a dynamic driving method, an active device, for example, TFT, is formed at each of pixels in the LCD. The active device is used to control each pixel individually. A gate driving circuit and a data driving circuit are a formed in the peripherical region of a TFT matrix array, that is, a pixel array in which data output display is formed. The driving circuits are built-in or attached to a separate circuit board. Here, the driving circuits are formed of TFTs having complementary structures to tolerate a higher voltage.

The gate driving circuit includes a shift register having a plurality of output lines, and a buffer having a plurality of input/output lines which are connected to the output lines of the shift register. Each output line of the buffer is connected to a scanning line of the pixel array.

The data driving circuit includes a shift register having a plurality of output lines, a buffer having a plurality of input/output lines which are connected to the output lines of the shift register, and a plurality of switching devices which are connected to the output lines of the buffer and driven by a signal input from the buffer output lines. Each switching device connects each signal line of the pixel array to a data signal input line.

The data signal applied to the signal line is turned on by a gate driving pulse generated from the gate driving circuit and transmitted to the liquid crystal and storage capacitor of the pixel through a TFT formed at the intersection of a scanning line and an activated signal line. Here, the storage capacitor receives the data signal together with the liquid crystal when the TFT is turned on, and helps the liquid crystal to maintain the signal.

In order to prevent the liquid crystal from deteriorating, the LCD is AC-driven. That is, positive and negative signals are alternately applied to the liquid crystal of each pixel according to a predetermined cycle. However, since the voltage variations in the positive and negative signals are different from each other, the AC-driving method makes the effective voltage applied to the liquid crystal unstable. Thus, the amount of light through each pixel varies, resulting in a flicker phenomenon of the final picture.

To prevent such flicker phenomenon, a data inversion method has been proposed. In this method, a data signal is applied to a predetermined pixel as positive and negative signals alternately. The data inversion may be divided into frame inversion, line inversion, column inversion and dot inversion. With the frame inversion, the positive and negative signals of the data signal are alternately applied to the whole pixel array according to each frame (field) so that the light transmissivity over all the pixels is changed whenever a picture is changed.

With the line inversion, the signals are alternately applied according to each of the scanning lines, so that the light transmissivity on each scanning line of the matrix array changes alternately. With the column inversion, the signals are alternately applied according to each of the signal lines, so that the light transmissivity is alternately changed on each signal line.

With the dot inversion, which is a combination of the line inversion and column inversion, the signals are alternately applied to make the polarities of neighboring pixels opposite to each other. By doing so, the neighboring pixels take on light transmissivities different from each other. The data signal input method using the dot inversion can minimize the flicker because of the spatial averaging of the whole picture.

FIG. 1 shows a general LCD panel. A plurality of signal lines D1, D2, D3, etc. and scanning lines G1, G2, G3, etc. cross each other to form a matrix pixel array. A signal line and a scanning line are connected to each pixel, and a pixel electrode is connected to the drain electrode of TFT of each pixel. That is, the pixel electrode forms the matrix array. Here, either n-type or p-type TFTs are formed in all the pixels. In FIG. 1, n-type TFTs are employed, and a common voltage of each pixel is ground voltage. In the peripheral portion of the pixel array, a gate driving circuit 10 is connected to the scanning lines G1, G2, G3, etc. to drive the TFTs, and a data driving circuit 20 is connected to the signal lines D1, D2, D3, etc. to apply a data signal to the TFTs.

A conventional dot inversion method will be explained below with reference to FIGS. 2 and 3. FIG. 2 shows a data driving range of the data driving circuit. In this case, the common voltage (Vcom) of each pixel is fixed at a DC voltage. In addition, the common voltage may be selected by a circuit designer. FIG. 3 shows the polarity of a data signal charged in the pixels in a predetermined frame (field) according to the dot inversion method for 4×4 matrix pixels of the LCD panel. Here, "+" represents a region ranging from V3 to V4, "−" represents a region from V1 to V2 in FIG. 2. When a predetermined scanning line is activated and the next scanning line is thereafter activated, that is, whenever the column of the activated scanning line changes, the polarity of the data signal changes in the data driving circuit.

Accordingly, on one signal line, the voltage polarity changes from the range V1 through V2 to the range V3 through V4 ,or from the range V3 through V4 to the range V1 through V2 whenever the row is changed. This, however, widens the voltage variation, resulting in an increase of power consumption.

SUMMARY OF THE INVENTION

Accordingly, the present invention is directed to a TFT-LCD that substantially obviates one or more of the problems due to limitations and disadvantages of the related art.

An object of the invention is to provide a liquid crystal display panel in which the power consumption of its column driver decreases when the panel is driven in the dot inversion mode.

Another object of the invention is to provide a TFT-LCD in which the duration of a voltage potential, which is maintained for a certain duration for a predetermined signal line, is extended. Another object is to reduce the voltage variation per unit time and decrease the power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display panel using a dot inversion method includes a pixel array on which a plurality of pixels are arranged in the form of matrix of n rows and m columns, N signal lines for applying a data signal to a predetermined pixel, a plurality of switching devices each of which is formed at every pixel so as to turn on or turn off a path through which a data signal from a predetermined signal line is transmitted to a predetermined pixel according to a control signal, and M control lines for applying the control signal to each switching device, in which the (2n−1)th signal line diverges at a predetermined point and passes through the (2n−1)th and 2nth pixel columns in common, and the 2nth signal line diverges at a predetermined point and passes through the 2nth and (2n−1)th pixel columns in common, odd pixels of the 2nth pixel column receiving a data signal loaded on the 2nth signal line, even pixels of the 2nth pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the 2nth signal line.

In another aspect, the present invention provides a data signal driving method for dot inversion in a liquid crystal display panel including a plurality of pixels arranged in the form of matrix of N rows and M columns, and N signal lines for applying a data signal to a predetermined pixel, wherein the (2n−1)th signal line diverges at a predetermined point and passes through the (2n−1)th and 2nth pixel columns in common, and the 2nth signal line diverges at a predetermined point and passes through the 2nth and (2n−1)th pixel columns in common, odd pixels of the 2nth pixel column receiving a data signal loaded on the 2nth signal line, even pixels of the 2nth pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the 2nth signal line, the method including the steps of: receiving a pixel data signal in series in horizontal synchronism and vertical synchronism, the pixel data signal forming a predetermined picture; making the (2n−1)th pixel data signal have a first polarity, and the 2nth pixel data signal have a second polarity, in horizontal synchronism; applying the 2nth data signal to the 2nth signal line, and the (2n−1)th data signal to the (2n−1)th signal line during the (2n−1)th horizontal synchronous section, the 2nth and (2n−1)th data signals being from the pixel data signal having a polarity set at step (c), the 2nth and (2n−1)th data signals corresponding to a predetermined horizontal synchronous section; and applying the (2n−1)th data signal to the 2nth signal line, and the 2nth data signal to the (2n−1)th signal line during the 2nth horizontal synchronous section, the 2nth and (2n−1)th data signals being from the pixel data signal having a polarity set at step (c), the 2nth and (2n−1)th data signals corresponding to a predetermined horizontal synchronous section.

In a further aspect, there is provided a data signal driving device for dot inversion in a liquid crystal display panel including a plurality of pixels arranged in the form of matrix of N rows and M columns, and N signal lines for applying a data signal to a predetermined pixel, wherein the (2n−1)th signal line diverges at a predetermined point and passes through the (2n−1)th and 2nth pixel columns in common, and the 2nth signal line diverges at a predetermined point and passes through the 2nth and (2n−1)th pixel columns in common, odd pixels of the 2nth pixel column receiving a data signal loaded on the 2nth signal line, even pixels of the 2nth pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the 2nth signal line, the device including: N driving means for receiving a pixel data signal in series in horizontal synchronism and vertical synchronism, making the (2n−1)th and 2nth pixel data signals have first and second polarities, respectively, in a predetermined horizontal synchronism, and applying the (2n−1)th and 2nth pixel data signals to the (2n−1)th and 2nth signal lines respectively, the pixel data signal forming a predetermined picture; a 1-bit counter for counting a horizontal synchronous signal, and outputting the counted value as first and second logic states; and switching means for applying a signal from the (2n−1)th driving means to the (2n−1)th signal line and a signal from the 2nth driving means to the 2nth signal line, or applying the signal from the (2n−1)th driving means to the 2nth signal line and the signal from the 2nth driving means to the (2n−1)th signal line, according to a logic state of the count value output from the 1-bit counter, the switching means being provided to the output lines of (2n−1)th and 2nth driving means, respectively.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 4:
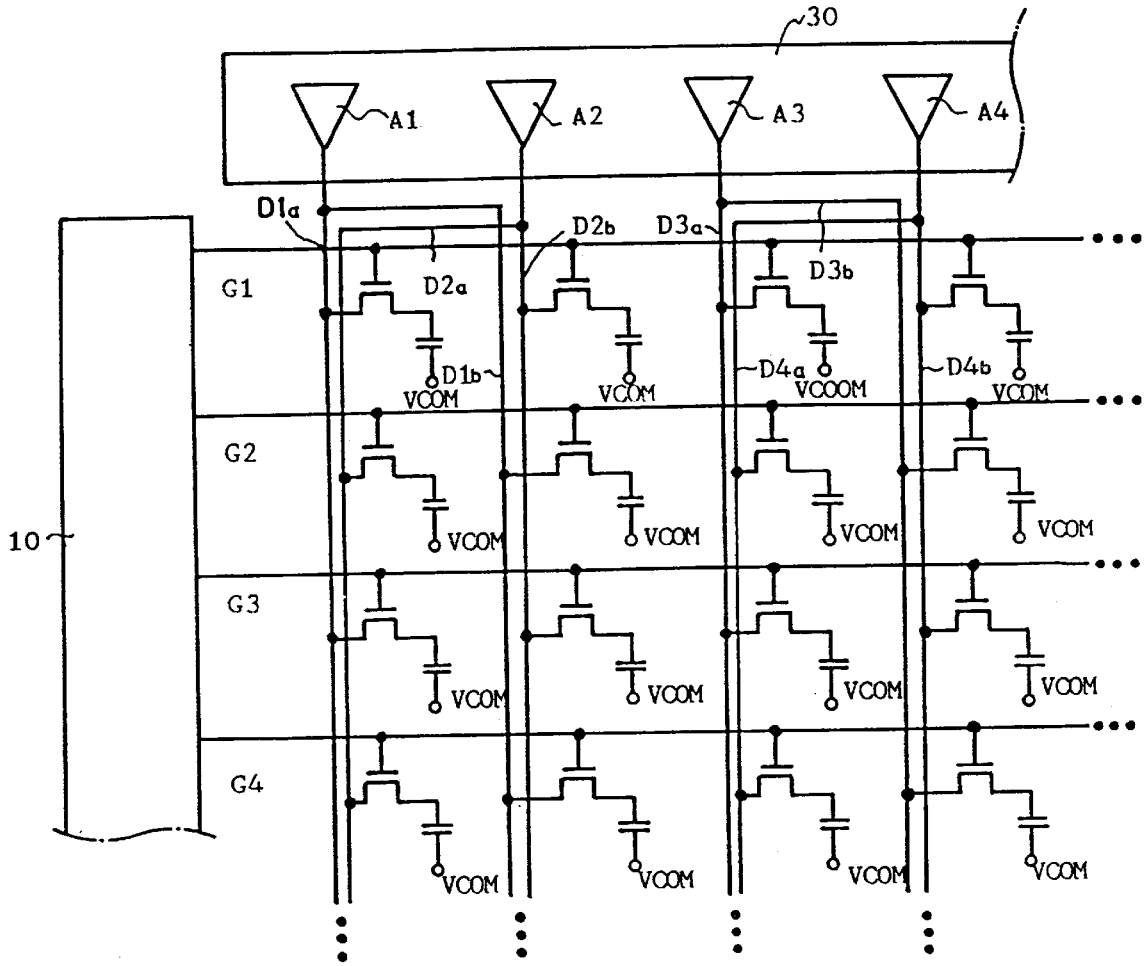
FIG. 4 shows an LCD panel configuration according to an embodiment of the present invention.

FIG. 4 shows an LCD panel configuration according to the present invention. Referring to FIG. 4, (2n−1)th signal lines D1*a*, D1*b*, D3*a*, D3*b*, . . . diverge at a predetermined point, and pass through (2n−1)th pixel column and 2nth pixel column in common. Similarly, 2nth signal lines D2*a*, D2*b*, D4*a*, D4*b*, . . . diverge at a predetermined point, and pass through 2nth pixel column and (2n−1)th pixel column in common.

Here, odd pixels among the pixels forming the 2nth pixel column receive data loaded on 2nth signal lines, such as D2*b* and D4*b*, and even pixels among them receive data loaded on (2n−1)th signal lines, such as D1*b* and D3*b*. Odd pixels among the pixels forming the (2n−1)th pixel column receive data loaded on (2n−1)th signal lines, such as D1*a* and D3*a*, and even pixel among them receive data loaded on 2nth signal lines, such as D2*a* and D4*a*. That is, two signal lines pass through each pixel, and only one of the signal lines is connected to each pixel. The scanning line configuration of the LCD panel according to the present invention is the same as that of the conventional LCD panel.

Figure 5:
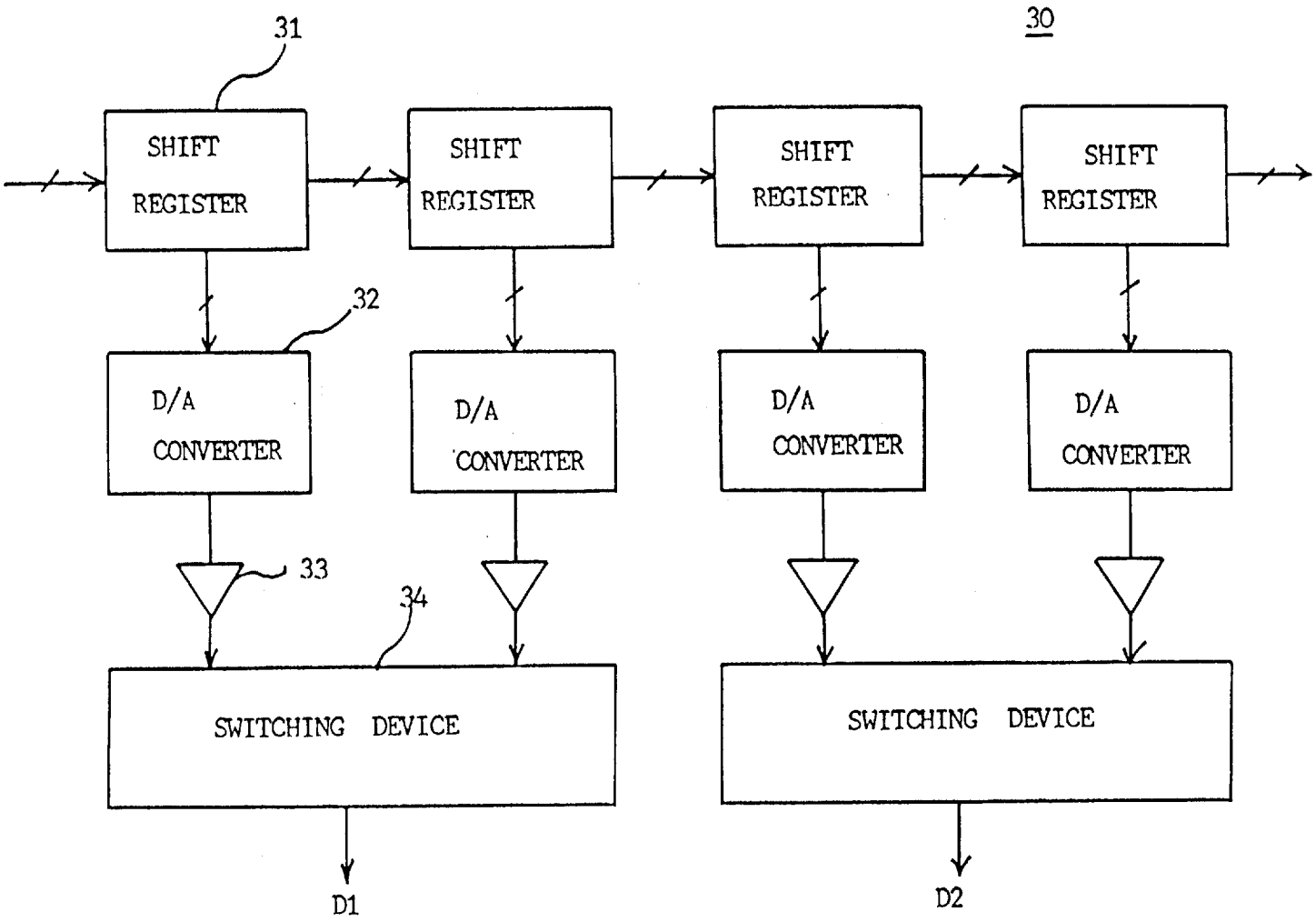
FIG. 5 shows a data driving circuit used in the LCD panel of the present invention.

The aforementioned signal line configuration will be explained below using the first and second pixel columns as an example. The output signal from a portion Al of the data driving circuit 30 drives pixels (1,1), (2,2), (3,1), (4,2), and the output signal from a portion A2 drives pixels (1,2), (2,1), (3,2), (4,1). Here, portions A1 to A4 in the data driving circuit 30 represent predetermined configurations for applying data to each signal line. FIG. 5 shows the data driving circuit 30. This is true when the data driving circuit 30 includes a plurality of shift registers 31 having a plurality of output lines, a plurality of digital-to-analog converters 32 having a plurality of input lines connected to the output lines of the shift register 31 and a plurality of buffers 33 having a single input line connected to the output line of the digital-to-analog converters 32 ,and a plurality of switching devices 34 connected to the output line of the buffer 33 and driven by a signal input from the buffer 33 output lines. Each switching device 34 connects the data signal input line to each signal line of the pixel array.

Figure 2:
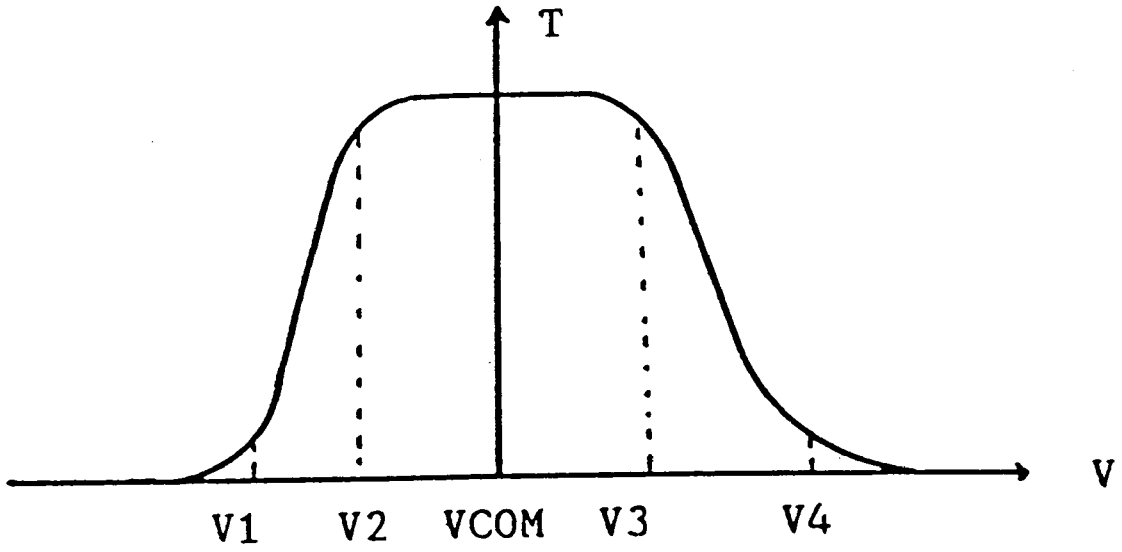
FIG. 2 PRIOR ART
FIG. 2 shows a data signal driving range of a data driving circuit of an LCD panel.
Figure 3:
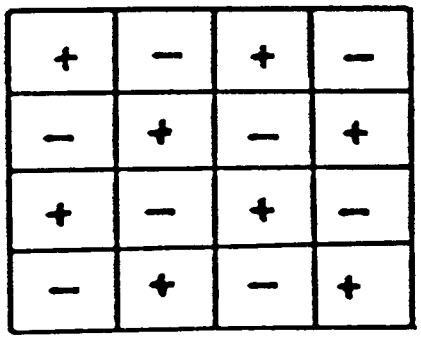
FIG. 3 PRIOR ART
FIG. 3 shows the polarity of a data signal charged in the pixels in a predetermined frame (field) according to the dot inversion method in case of 4×4 matrix pixels of the LCD panel.

If a frame has the polarity shown in FIG. 3, the portion A1 drives only pixels having (+) polarity, and portion A2 drives only pixels having (−) polarity. Accordingly, the output switching of portions A1 to A4 driving the pixels are limited in a range from V1 to V2 ,or range from V3 to V4 in the data driving range of FIG. 2. This reduces the voltage variation per predetermined unit time.

However, during the above-described operation, the locations of the portions A1 to A4 are changed, which provide a signal to be applied to a pixel corresponding to the (2n−1)th scanning line, and another signal to be applied to a pixel corresponding to (2n)th scanning line. Thus, a process for shifting or sorting serial data for each pixel at a certain moment is needed. That is, a signal output from the (2n−1)th signal line driving portion should be applied to the 2nth signal line, and a signal output from the 2nth signal line driving portion is applied to the (2n−1)th signal line at a certain moment. Also, a signal output from the (2n−1)th signal line driving portion should be applied to the (2n−1)th signal line, and a signal output from the 2nth signal line driving portion is applied to the 2nth signal line at the following certain moment. Accordingly, the LCD panel must have a switching device for exchanging the signals between the (2n−1)th and 2nth signal line driving portions and (2n−1)th and 2nth signal lines.

Figure 6:
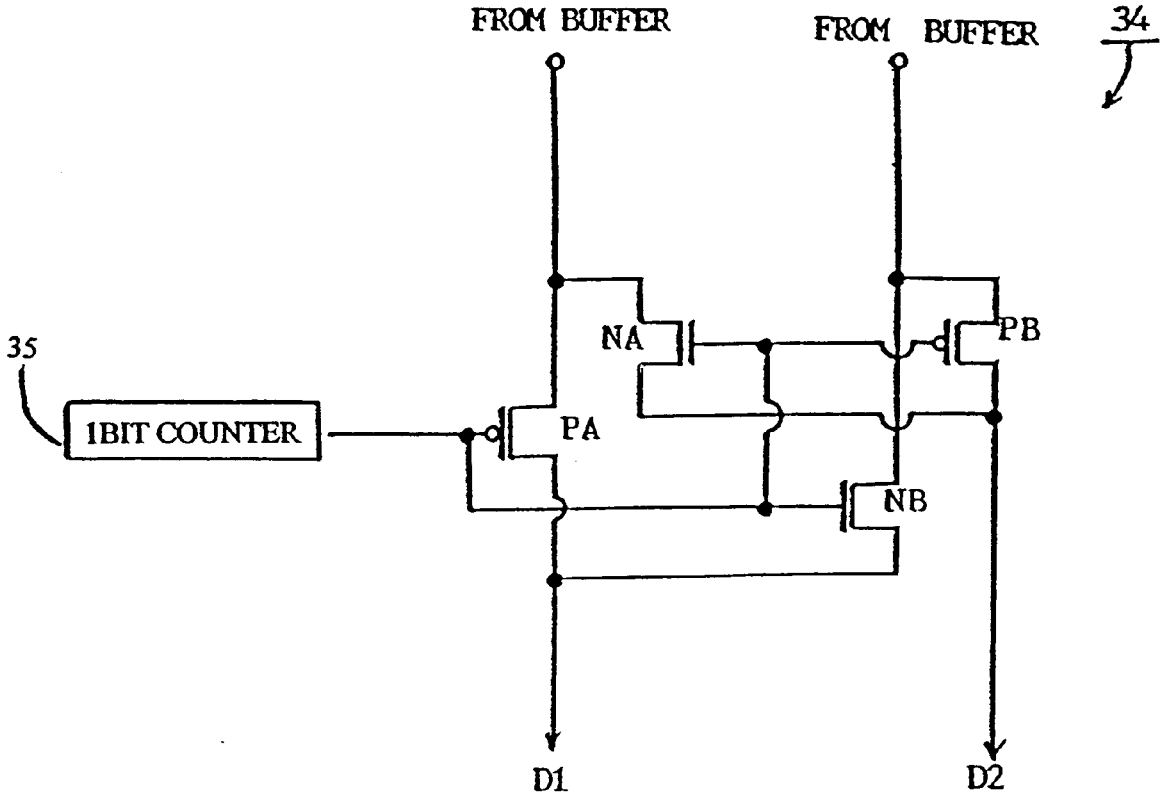
FIG. 6 shows a switching device used in the LCD panel of the present invention.

FIG. 6 shows the switching device 34 formed to connect to the output line of the buffer 33 ,and to output the first and second signal lines D1 and D2. Referring to FIG. 6, the switching device includes a first NMOS transistor NA for applying a data signal which is applied to its drain from the buffer 33 to the second signal line D2 when it is turned on. The switching device 34 also includes a first PMOS transistor PA for applying a data signal from the buffer 33 to the first signal line D1 when it is turned on. A second PMOS transistor PB is for applying a data signal from the buffer 33 to the second signal line D2 when it is turned on. A second NMOS transistor NB is for applying a data signal from the buffer 33 to the first signal line D1 when it is turned on.

The first NMOS transistor NA receives a signal from a 1-bit counter 35 at its gate to turn NA on or off accordingly. The 1-bit counter counts a horizontal synchronous signal applied to the data driving circuit 30 and outputs the counted value as "low" and "high" signals. The first PMOS transistor PA having its source connected to the drain of the first NMOS transistor NA is turned on or off according to the output signal state of the 1-bit counter. The second PMOS transistor PB receives the data signal at its source from the buffer 33, and is turned on or off according to the output signal state of the 1-bit counter applied to its gate. The second NMOS transistor NB having its drain connected to the source of the second PMOS transistor PB is turned on or off according to the output signal state of the 1-bit counter applied to its gate.

The output signal state of the 1-bit counter is maintained at a "low" level when a "high" signal is applied to the first scanning line G1, synchronized with the horizontal synchronous signal. The output signal state of the 1-bit counter is maintained at a "high" level when a "high" signal is applied to the second scanning line G1. Accordingly, during the operation of the (2n−1)th scanning line, since the output signal state of the 1-bit counter becomes a "low" level, the data signal from the buffer 33 is applied to the first signal line D1, and the data signal from the buffer 33 is applied to the second signal line D2.

On the other hand, during the operation of the 2nth scanning line, since the output signal state of the 1-bit counter becomes a "high" level, the data signal from the buffer 33 is applied to the first signal line D1, and the data signal from the buffer 33 is applied to the second signal line D2. Therefore, the power consumption is reduced in the TFT-LCD according to the present invention. The amount of the reduced power consumption will be described below using equations.

First, the absolute magnitude of voltage in each range of FIG. 2 is assumed to be "v" according to the following formula:

$$|V1-V2|=|V3-V2|=|V4-V3|=v$$

Accordingly, the switching width of the voltage applied to each signal line becomes v. Then, the power consumption is calculated according to the following formula:

$$\text{power consumption} = \text{total capacitance element} \times (\text{voltage variance})^2 \quad (1)$$

In the formula (1), the total capacitance element is 2C.

$$(\text{voltage variation})^2 = V^2 = \int_{x=\frac{v}{2}}^{\frac{3v}{2}} \int_{y=\frac{v}{2}}^{\frac{3v}{2}} (x-y)^2 \frac{dx\,dy}{v^2} = \frac{v^2}{6} \quad (2)$$

Accordingly, combining the results of formula (2) and formula (1), the power consumption becomes $(Cv^2)/3$.

Figure 1:
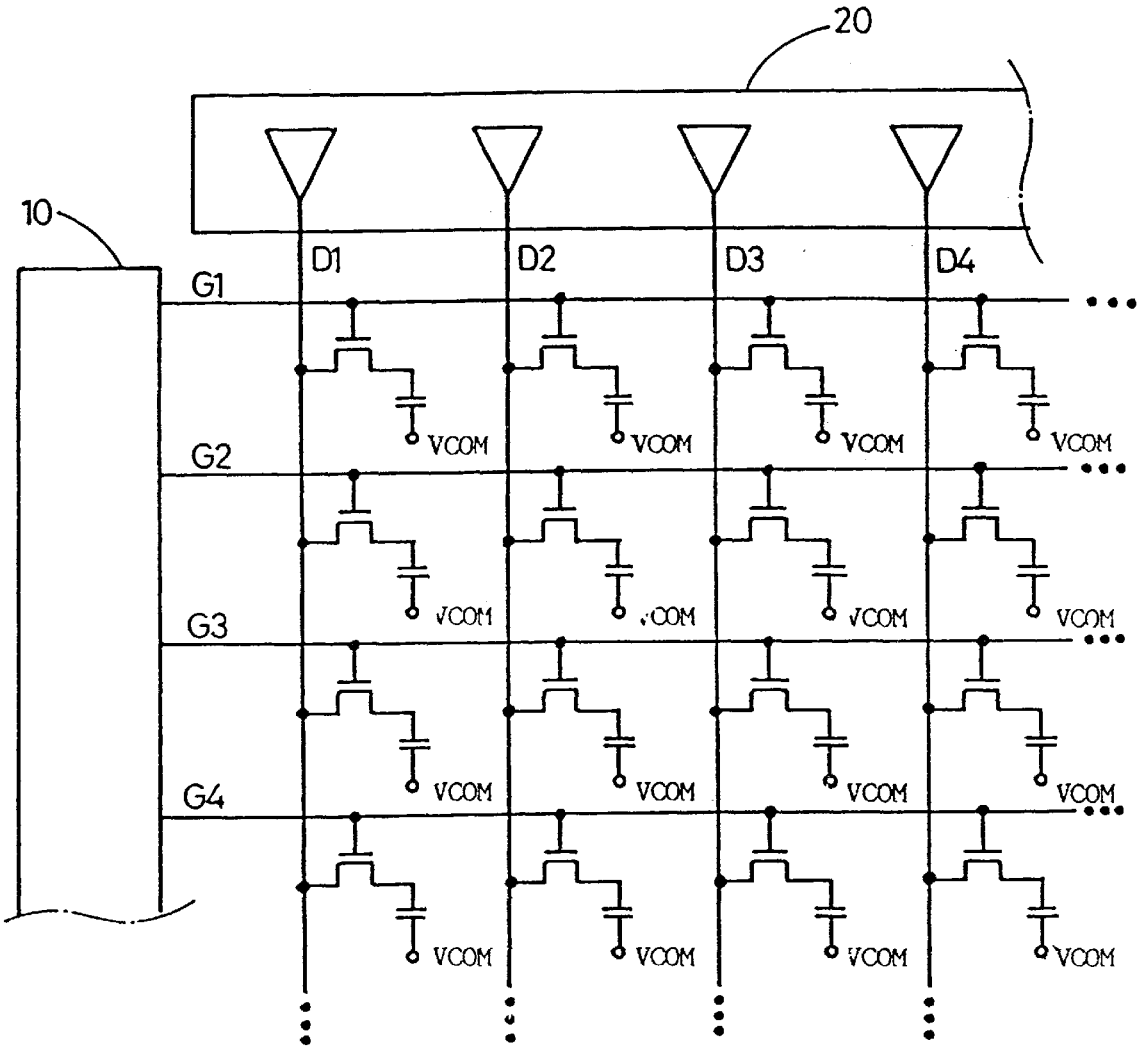
FIG. 1 PRIOR ART
FIG. 1 shows a conventional LCD panel configuration.

The power consumption of the conventional LCD panel shown in FIG. 1 is $Cv^2$. Thus, according to the present invention, the power consumption of the LCD panel is greatly reduced to one-third of the conventional power consumption.

The relation of formulae (1) and (2) will be described below. It is assumed that the magnitude of voltage V1 shown in FIG. 2 is −(3v/2), the magnitude of voltage V2 is −v/2,the magnitude of voltage V3 is v/2,and the magnitude of voltage V4 is 3v/2. Then, the voltage variation for the conventional LCD panel is obtained through the following formula:

$$V^2 = \int_{x=\frac{v}{2}}^{\frac{3v}{2}} \int_{y=\frac{-3v}{2}}^{-\frac{v}{2}} (x-y)^2 \frac{dx dy}{v^2} = 2v^2 + \frac{13v^2}{6} \approx 4v^2$$

$$\therefore V = 2v$$

On the other hand, the voltage variation in the preferred embodiment of the LCD panel of the present invention is obtained through the following formula:

$$V^2 = \int_{x=\frac{v}{2}}^{\frac{3v}{2}} \int_{y=\frac{v}{2}}^{\frac{3v}{2}} (x-y)^2 \frac{dx dy}{v^2} = \frac{v^2}{6}$$

$$\therefore V = \frac{v}{\sqrt{6}}$$

Accordingly, for a uniform current driving method, the LCD panel of the present invention uses only $$\frac{1}{\sqrt[2]{6}}$$

of the voltage variation of the conventional LCD panel.

It will be apparent to those skilled in the art that various modifications and variations can be made in the TFT-LCD of the present invention without departing from the spirit or scope of the invention. Thus, it is intended that the present invention cover the modifications and variations of this invention provided they come within the scope of the appended claims and their equivalents.

What is claimed is:

1. A liquid crystal display panel using a dot inversion method, comprising:

a pixel array with a plurality of pixels arranged in the form of a matrix of N rows and M columns;

N signal lines each for applying a data signal to a predetermined pixel;

a plurality of switching devices each formed at one of the plurality of pixels to turn on or turn off a path through which a data signal from a predetermined signal line is transmitted to a predetermined pixel according to a control signal;

M control lines for applying the control signal to each switching device;

wherein the (2n−1)th signal line diverges at a predetermined point and passes through the (2n−1)th and (2n)th pixel columns in common, and the (2n)th signal line diverges at a predetermined point and passes through the (2n)th and (2n−1)th pixel columns in common, odd pixels of the (2n)th pixel column receiving a data signal loaded on the (2n)th signal line, even pixels of the (2n)th pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the (2n)th signal line.

2. A data signal driving method for dot inversion in a liquid crystal display panel including a plurality of pixels arranged in the form of a matrix of N rows and M columns, and N signal lines each for applying a data signal to a predetermined pixel, wherein the (2n−1)th signal line diverges at a predetermined point and passes through the (2n−1)th and (2n)th pixel columns in common, and the (2n)th signal line diverges at a predetermined point and passes through the (2n)th and (2n−1)th pixel columns in common, odd pixels of the (2n)th pixel column receiving a data signal loaded on the (2n)th signal line, even pixels of the (2n)th pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the (2n)th signal line, the method comprising the steps of:

(a) receiving a pixel data signal in series in horizontal synchronism and vertical synchronism, the pixel data signal forming a predetermined picture;

(b) making the (2n−1)th pixel data signal have a first polarity, and the (2n)th pixel data signal have a second polarity, in horizontal synchronism;

(c) applying the (2n)th data signal to the (2n)th signal line, and the (2n−1)th data signal to the (2n−1)th signal line during the (2n−1)th horizontal synchronous section, the (2n)th and (2n−1)th data signals being from the pixel data signal having the first and second polarities set at step (b), the (2n)th and (2n−1)th data signals corresponding to a predetermined horizontal synchronous section; and (d) applying the (2n−1)th data signal to the (2n)th signal line, and the (2n)th data signal to the (2n−1)th signal line during the (2n)th horizontal synchronous section, the (2n)th and (2n−1)th data signals being from the pixel data signal having the first and second polarities set at step (b), the (2n)th and (2n−1)th data signals corresponding to a predetermined horizontal synchronous section.

3. The method as claimed in claim 2, wherein, if a vertical synchronous signal is detected after step (d), step (b) makes the (2n−1)th pixel data signal have a second polarity, and the (2n)th pixel data signal have a first polarity.

4. A data signal driving device for dot inversion in a liquid crystal display panel including a plurality of pixels arranged in the form of a matrix of N rows and M columns, and N signal lines each for applying a data signal to a predetermined pixel, wherein the (2n−1)th signal line diverges at a predetermined point and passes through the (2n−1)th and (2n)th pixel columns in common, and the (2n)th signal line diverges at a predetermined point and passes through the (2n)th and (2n−1)th pixel columns in common, odd pixels of the (2n)th pixel column receiving a data signal loaded on the (2n)th signal line, even pixels of the (2n)th pixel column receiving a data signal loaded on the (2n−1)th signal line, odd pixels of the (2n−1)th pixel column receiving the data signal loaded on the (2n−1)th signal line, even pixels of the (2n−1)th pixel column receiving the data signal loaded on the (2n)th signal line, the device comprising:

N driving means each receiving a pixel data signal in series in horizontal synchronism and vertical synchronism, making the (2n−1)th and (2n)th pixel data signals have first and second polarities, respectively, in a predetermined horizontal synchronism, and applying the (2n−1)th and (2n)th pixel data signals to the (2n−1)th and (2n)th signal lines respectively, the pixel data signal forming a predetermined picture;

a 1-bit counter for counting a horizontal synchronous signal, and outputting the counted value as first and second logic states; and switching means for applying the pixel data signal from the (2n−1)th driving means to the (2n−1)th signal line and for applying a signal from the (2n)th driving means to the (2n)th signal line, or applying the signal from the (2n−1)th driving means to the (2n)th signal line and the signal from the (2n)th driving means to the (2n−1)th signal line, according to a logic state of the counted value from the 1-bit counter, the switching means being provided to output lines of (2n−1)th and (2n)th driving means, respectively.

5. The device as claimed in claim 4, wherein the switching means comprises:

a first NMOS transistor for applying output data of the (2n−1)th driving means to the (2n)th signal line when it is turned on, the output data being sent to the drain of the first NMOS transistor, the first NMOS transistor being turned on or turned off by receiving a signal output from the 1-bit counter at a gate of the first NMOS transistor;

a first PMOS transistor for applying the output data of the (2n−1)th driving means to the (2n−1)th signal line when it is turned on, the first PMOS transistor being turned on or turned off according to a logic state of the 1-bit counter output signal applied to a gate of the first PMOS transistor, the source of the first PMOS transistor being connected to the drain of the first NMOS transistor;

a second PMOS transistor for applying the output data of the (2n−1)th driving means to the (2n)th signal line when it is turned on, the second PMOS transistor being turned on or turned off according to an output signal applied to its gate, the second PMOS transistor receiving the data signal output from the (2n)th driving means to its source; and a second NMOS transistor for applying the output data of the (2n)th driving means to the (2n)th signal line when it is turned on, the second PMOS transistor being turned on or turned off according to a state of the 1-bit counter output signal applied to its gate, the drain of the first PMOS transistor being connected to the source of the second NMOS transistor.

6. A data signal driving device in a liquid crystal display panel including a plurality of pixels arranged as a matrix of N rows and M columns, comprising:

N signal lines each for applying a data signal to pixels associated with at least two of the N rows of the matrix, the (2n−1)th signal line diverging at a predetermined point and passing through the (2n−1)th and (2n)th columns in common, and the (2n)th signal line diverging at a predetermined point and passing through the (2n)th and (2n−1)th columns in common;

N driving units each for receiving a pixel data signal and applying the pixel data signal to one of the N signal lines;

a 1-bit counter for generating a logic value; and switching means for applying the pixel data signal received in each of the N driving units to one of two signal lines associated with each of the driving units in accordance with the logic value of the 1-bit counter.

7. The device as claimed in claim 6, wherein the switching means comprises:

a first NMOS transistor for applying the pixel data signal of an odd driving unit to an even signal line when the first NMOS transistor is turned on in accordance with the logical value from the 1-bit counter;

a first PMOS transistor for applying the pixel data signal of an odd driving unit to an odd signal line when the first PMOS transistor is turned on in accordance with the logic value of the 1-bit counter, a source of the first PMOS transistor being connected to a drain of the first NMOS transistor;

a second PMOS transistor for applying the pixel data signal of an odd driving unit to an even signal line when the second PMOS transistor is turned on in accordance with the logic value of the 1-bit counter; and a second NMOS transistor for applying the pixel data signal of an even driving unit to an even signal line when the second NMOS transistor is turned on in accordance with the logical value of the 1-bit counter, a drain of the first PMOS transistor being connected to a source of the second NMOS transistor.

8. The device as claimed in claim 6, wherein odd pixels of an even column of the matrix receive a data signal from an even signal line, even pixels of an even column of the matrix receive a data signal from an odd signal line, odd pixels of an odd column of the matrix receive a data signal from an odd signal line, and even pixels of an odd column of the matrix receive a data signal from an even signal line.

* * * * *